United States Patent [19]

Bowles

[11] 4,142,474

[45] Mar. 6, 1979

[54] SEWING MACHINE PATTERNING MEANS

[75] Inventor: Theodore L. Bowles, South Orange, N.J.

[73] Assignee: The Singer Company, New York, N.Y.

[21] Appl. No.: 857,484

[22] Filed: Dec. 5, 1977

[51] Int. Cl.[2] ..... D05B 3/02

[52] U.S. Cl. ..... 112/158 E

[58] Field of Search ..... 112/158 E, 158 R, 158 A, 112/121.13

[56] References Cited

U.S. PATENT DOCUMENTS

| | | | |
|---|---|---|---|
| 3,926,133 | 12/1975 | Herron et al. | 112/158 R |
| 3,977,338 | 8/1976 | Wurst et al. | 112/158 E |
| 3,987,739 | 10/1976 | Wurst et al. | 112/158 E |

*Primary Examiner*—Peter Nerbun

*Attorney, Agent, or Firm*—William V. Ebs; Robert E. Smith; Edward L. Bell

[57] ABSTRACT

Sewing machines of the type having electronic pattern control means are provided with circuitry which upon the selection of any pattern by the pattern selector means causes the needle to initially go to a central position and the first stitch formed to be a straight stitch in every case.

4 Claims, 2 Drawing Figures

SEWING MACHINE PATTERNING MEANS

BACKGROUND OF THE INVENTION

1. FIELD OF THE INVENTION

The invention relates to sewing machines and more particularly is directed to means for controlling the first stitch in an electronic machine capable of forming selected stitch patterns automatically.

2. DESCRIPTION OF THE PRIOR ART

In electronic sewing machines of the type shown and described, for example, in U.S. Pat. No. 3,872,808 issued to the same assignee as the present invention, the sewing needle, in addition to reciprocating vertically, moves from side to side with respect to the throat plate of the machine during pattern sewing. A throat plate having an aperture accommodating the maximum lateral movement of the needle for any pattern selectable on the machine could be used, however, since work being sewn is unsupported over the needle aperture and the quality of most stitches depends upon the amount of support the work receives around the reciprocating needle, it is undesireable to have excessive clearances between the needle and the aperture. Interchangeable throat plates with apertures suited to the particular sewing operations which may be performed are therefor generally provided for use by the sewing machine operator.

When sewing is initiated following the insertion in the machine bed of a throat plate with an aperture smaller than that just previously used and the selection of a new pattern or straight stitching suited to the smaller aperture, the sewing needle may be caused to engage the plate and break due to the first stitch after selection being a retained stitch from the last pattern.

SUMMARY OF THE INVENTION

In accordance with the invention, control means are provided for causing the first stitch after selection to be a straight stitch formed through the center of the throat plate aperture. Such control means includes circuitry effective in response to the operation of any pattern or straight stitch selection button to cause the sewing needle to be disposed in a center position by the needle bar actuator, and to remain in such position until the completion of one stitch.

DESCRIPTION OF THE DRAWINGS

Other objects and advantages of the present invention will become apparent from the following detailed description of a preferred embodiment of the invention when taken in conjunction with the following drawings wherein.

DESCRIPTION OF THE PREFERRED EMBODIMENT OF THE INVENTION

Figure 1:
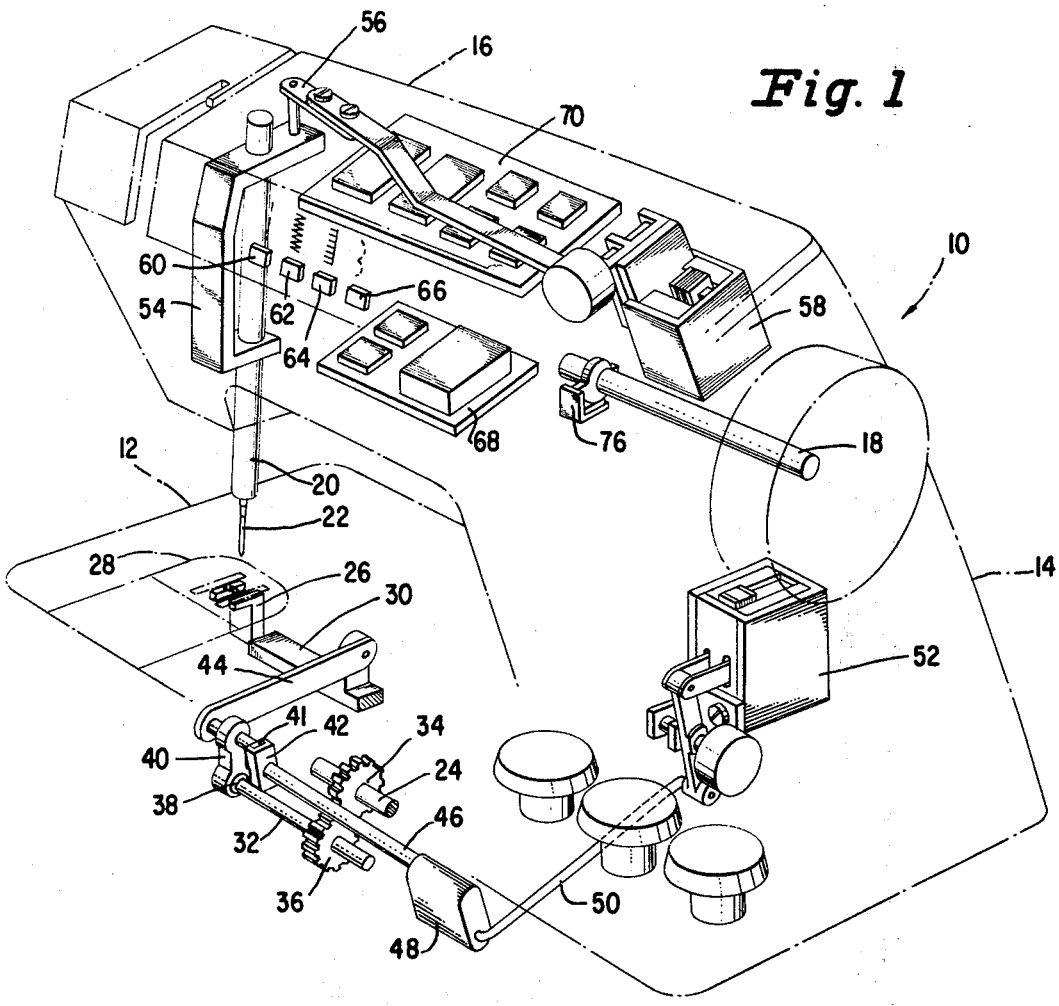
FIG. 1 is a perspective view of a sewing machine partially shown in phantom and in which the preferred embodiment of the invention is incorporated; and, FIG. 2 is a functional circuit diagram of the preferred embodiment of the invention incorporated in the machine shown in FIG. 1.

Referring to FIG. 1, there is shown therein in phantom lines a sewing machine casing 10 including a bed portion 12, a standard 14 rising from the bed portion and a bracket arm 16 overhanging the bed and interconnected with the standard. As is well known in the sewing machine art, an electric motor (not shown) may be provided for driving an arm shaft 18 which is connected to a needle bar 20 in a conventional manner (not shown) to reciprocate the needle 22 in an endwise manner for penetrating a fabric with a thread for forming stitches therein. The arm shaft 18 is driven in timed relationship with a bed shaft 24 which is also suitably connected to the electric motor mentioned above for reciprocating a feed dog 26 supported below a throat plate 28 disposed in the bed 12 for feeding a fabric across the top surface of the bed portion 12. The feed dog 26 is carried by a feed bar 30 and motion is imparted to the feed bar 30 and the feed dog 26 by a feed drive shaft 32 driven by gears 34 and 36 respectively fixed to the bed shaft and the feed drive shaft 24 and 32, a cam 38 on the feed drive shaft 32, and a pitman 40 embracing the cam 38 and connected to a slide block 41 disposed in a slotted feed regulator guideway 42. A link member 44 pivotably connects the pitman 40 with the feed bar 30 such that the magnitude and direction of the feed stroke of the feed dog 26 will be dependent upon the inclination of the guideway 42. In order to control the inclination of the guideway 42 and thus the magnitude and direction of feed stroke of the feed dog 26, a rock shaft 46 is fixedly connected to the guideway 42 and is connected at its other end to a rock arm 48. The rock arm 48 is connected by a link member 50 to an electro-mechanical feed actuator 52. As will be apparent hereinafter, the actuator 52 is operable in accordance with control signals for initiating movement of the link 50 and rock arm 48 to thereby position the guideway 42 so that the magnitude and direction of the feed stroke of the feed dog will be controlled in accordance with the magnitude and direction of movement of the actuator 52.

As further illustrated in FIG. 1, the needle bar 20 is supported in a substantially U-shaped bracket or gate 54 such that the needle bar may reciprocate in an endwise relationship relative to the gate 54. The gate 54 also supports a needle bar 20 for lateral jogging movement relative to the direction of line of feeding of the fabric so that ornamental stitches such as zig-zag stitches or the like may be produced by initiating such lateral movement of the needle bar 20 relative to the direction of line of fabric feed. In order to initiate lateral jogging movement of the needle bar 20, the gate 54 has pivotally connected thereto a link 56, as illustrated in FIG. 1, which is in turn connected at it opposite end to a linear actuator 58 for initiating linear movement of the link arm 56. The magnitude and direction of movement of the link 56 will be determined in accordance with control signals provided to the linear actuator 58 which control the magnitude and direction of movement of the linear actuator 58. It will be apparent that as the link 56 rocks or pivots the gate 54, the needle bar 22 will be jogged in a relative lateral movement, which in itself is well known in the art.

Figure 2:
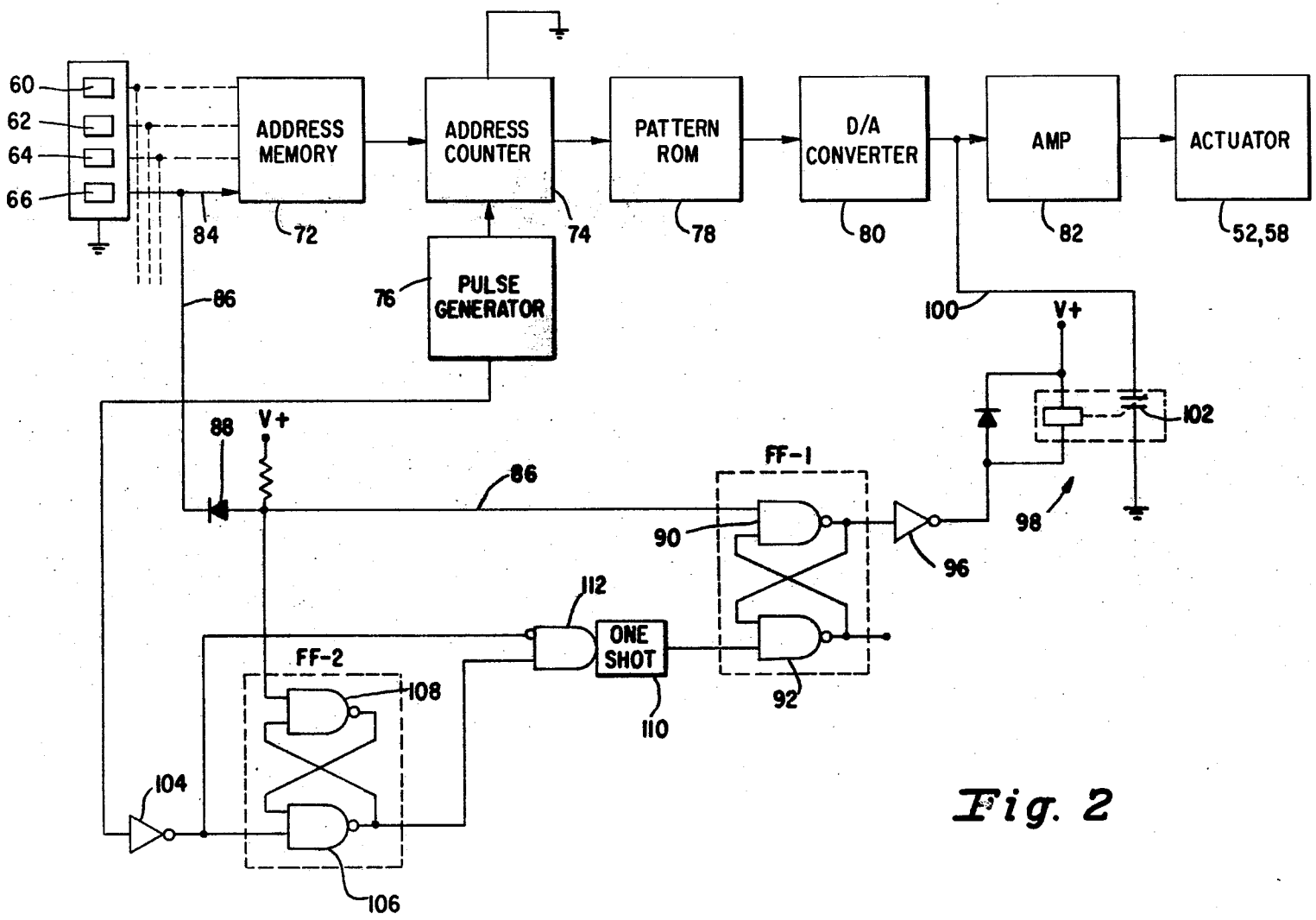

As briefly mentioned above, electronic means are provided for generating pattern information which is supplied as control signals to the sewing instrumentalities of the machine in order to produce ornamental patterns or the like. Referring both to FIGS. 1 and 2, a selector mechanism or switching array is provided on the front face of the bracket arm 16 and includes switches 60, 62, 64 and 66 each having a pattern indicated on the face plate above its respective switch. Means are also provided for storing stitch pattern data in the form of stitch position coordinates and also logic means for selecting and releasing the stitch information in timed relationship with the operation of the sewing machine. Such means may be provided in the form of solid state components supported on printed circuit boards as for example that shown at 68 and 70 in FIG. 1. FIG. 2, illustrates a diagrammatic representation of the solid state electronic circuitry incorporated in the machine referred to above. As shown therein, the pattern selector switches 60, 62, 64 and 66 are connected to an address memory 72. For purposes of explanation, the circuitry will be described in relation to only one switch, namely switch 66, although it will be understood that the description of switch 66 is equally applicable to the other switches illustrated and also that only four switches are shown for purposes of illustration and that more than four switches can be provided if desired. When switch 66 is actuated by depressing the same, it is electrically connected to the address memory 72 which address memory generates a code word representing the pattern selected. The code word is then presented to an address counter 74 for determining the starting point of the counter. A pulse generator, which as shown in FIG. 1, is physically connected to the arm shaft 18, so that as it is driven thereby it provides pulses to the address counter in timed relationship to the operation of the machine. The pulse generator 76 starts the counter to provide an address to the pattern ROM (read-only-memory) which ROM puts out digital code words for operating the sewing instrumentalities such as the needle and feed mechanisms. The circuitry of FIG. 2 thus far described provides signals to only one of the sewing instrumentalities although it will be understood that the same type circuitry would be used for both the bight or needle and feed mechanisms of the sewing machine. The digital code words produced by the ROM are fed to a digital-to-analog converter 80 which converts the digital code words to analog signals. These analog signals are fed to an amplifier 82 where they are amplified for use by an actuator which actuator is representitive of the actuators 58 or 52 of FIG. 1. The said circuit thus far described with respect to FIG. 2, is known in the sewing machine art and a more detailed description thereof can be found in U.S. Pat. Nos. 3,872,808 and 3,984,745, referred to above.

There is a possibility that when the operator proceeds from one pattern to a second pattern, that the needle may remain in position of the last stitch of the first selected pattern. When the machine is again started by the operator, the first stitch of the second selected pattern may be formed in accordance with the signal of the last stitch of the first selected pattern. This is not always desirable in that it may affect the esthetics of the new pattern and also may cause the needle to come down in a position which may result in needle breakage. As briefly described above, it is a prime purpose of the present invention to prevent this occurrence and to insure that the first stitch of any new selected pattern will be a common center needle straight stitch.

Again referring to FIG. 2, it will be seen that the line 84 connecting the switch 66 to the address memory 72 also has a line 86 connected thereto so that the signal produced when the pattern selection button 66 is actuated is also fed through line 86 to diode 88 and thence to a set-reset flip-flop circuit FF-1. FF-1 includes NAND gates 90 and 92 and such signal which is "low" in positive logic terms is fed to NAND gate 90. The low input signal to NAND gate 90 causes the output of FF-1, if low, to go high, or to remain in high if already there. The high output of FF-1 is inverted to a low by inverter 96 and the low provides for the energization of relay 98 and the grounding over line 100 of the needle actuator through contact 102 of the relay. When grounded, the actuator drives the sewing needle to a central position if not already in that position.

The relay 98 is disconnected from ground in response to the operation of the pulse generator 76 which as shown connects through an inverter 104 with a reset flip-flop circuit FF-2 including NAND gates 106 and 108. Before rotation of the machine motor and pulse generator the input to FF-2 may be high or low depending upon the position of the arm shaft. However, when the machine motor is set into operation by an operator as through a foot controller or the like to sew the pattern selected with switch 66, alternating high and low pulses are provided by the pulse generator 76, and during the first transition of the pulse generator signal from a low to a high an initial straight stitch is completed with the needle in its central position. After completion of such initial stitch and during said first transition from a low to a high signal which is an input to the inverter 104, and therefor is a high to low input to NAND gate 106, one shot multivibrator 110 which is connected to AND gate 112 fires and produces a low signal pulse as an input to NAND gate 92 of FF-1. Flip-flop FF-1 in response to the low signal from the multivibrator and high input bias voltage V+ reestablished as an input to NAND gate 90 after the momentary actuation and release of switch 66, produces a low output signal which is inverted by inverter 96 and the relay is thereupon deenergized. Line 100 opens at the relay contact 102 disconnecting the actuator from ground, after which the actuator responds to bight signals which are the high signals from the pulse generator and the sewing needle produces stitches according to the pattern selected.

While the invention has been described in its preferred embodiment it will be apparent to those skilled in the art that various changes and modifications can be made therein without departing from the spirit and scope of the invention as set forth in the appended claims.

Having thus set forth the nature of the invention, what is claimed herein is:

1. In a sewing machine including a needle bar supporting an endwise reciprocable needle, a work bed on the machine, a throat plate on the work bed with an aperture for the needle, an actuator cooperating with the needle for moving the needle laterally, work feeding means, a plurality of stitch selectors individually operable to cause said actuator and work feeding means to produce a selected stitch, the combination comprising a signal generator to produce a pulsating signal during operation of the machine, circuitry connected with the stitch selecting means and the signal generator operable in response to actuation of any one of the stitch selectors to produce a temporary signal causing the actuator to move the needle to a central position over the throat plate aperture.

2. The combination of claim 1 wherein said circuitry includes relay means for controlling the actuator and flip-flop circuit means responsive to the stitch selector and signal generator for controlling the relay means.

3. The combination of claim 2 wherein the flip-flop circuit means includes a set-reset flip-flop circuit connected to the stitch selector and relay means, and a reset flip-flop circuit connected to the pulse generator and the set-reset flip-flop circuit.

4. The combination of claim 3 wherein the circuit means includes a one-shot multivibrator between the reset flip-flop circuit and the set-reset flip-flop circuit.

* * * * *